US010914094B2

(12) United States Patent
Charrin

(10) Patent No.: US 10,914,094 B2
(45) Date of Patent: Feb. 9, 2021

(54) SLIDE LOCK POST ASSEMBLY

(71) Applicant: Christian Charrin, Clearfield, UT (US)

(72) Inventor: Christian Charrin, Clearfield, UT (US)

( * ) Notice: Subject to any disclaimer, the term of this patent is extended or adjusted under 35 U.S.C. 154(b) by 0 days.

(21) Appl. No.: 16/383,643

(22) Filed: Apr. 14, 2019

(65) Prior Publication Data

US 2020/0325699 A1 Oct. 15, 2020

(51) Int. Cl.
*E04H 12/22* (2006.01)

(52) U.S. Cl.
CPC ..... *E04H 12/2292* (2013.01); *E04H 12/2269* (2013.01)

(58) Field of Classification Search
CPC . E04H 12/22; E04H 12/2292; E04H 12/2269; E04H 12/2276; E04H 12/2253
USPC ..... 52/170
See application file for complete search history.

(56) References Cited

U.S. PATENT DOCUMENTS 3,400,905 A * 9/1968 Van Dusen, Jr. ... E04H 12/2253 403/369
3,579,936 A * 5/1971 Andersson ..... E04H 12/2284 52/297
6,554,542 B2 * 4/2003 Mano ..... E02D 27/34 405/251
2005/0017148 A1 * 1/2005 Tung ..... E04H 12/2238 248/346.01
2005/0102925 A1 * 5/2005 Boyd ..... E04H 12/2269 52/155
2006/0038163 A1 * 2/2006 Ricci ..... E04H 12/2292 256/1

* cited by examiner

*Primary Examiner* — Christine T Cajilig
(74) *Attorney, Agent, or Firm* — Malcolm Pipes

(57) ABSTRACT

A slide lock post assembly repairs a damaged post. The assembly has a post slide plate and a wedge plate, collectively forming an anchor assembly. The anchor assembly fits within an inner cavity of an anchor receiver. The post slide plate attaches to a repair post and the anchor receiver attaches to a base post. The post slide plate slides into the anchor receiver and the resulting assembly holds the two posts rigidly together. The post slide plate has side walls that flare outwards ensuring that the post slide plate can't be pulled upwards and out of the anchor receiver. Security pins can be tightened against the post slide plate and anchor receiver such that the plate is secured within the receiver. A decorative shroud can be slid over the other parts of the slide lock post assembly to conceal said components and beautify the resulting post repair.

20 Claims, 3 Drawing Sheets

10

SLIDE LOCK POST ASSEMBLY

TECHNICAL FIELD

The present invention relates generally to the field of construction and repair of vertical posts; and more specifically, to a slide lock post assembly.

BACKGROUND

There are a myriad of different methods and systems for installing or constructing posts and similar support structures. However, almost invariably, when such post structures become damaged or fail, they must be completely replaced. And when the bases of posts are rigidly mounted in the ground or in concrete, replacement can be extraordinarily difficult, time-consuming and expensive.

What is needed is a quick, easy, inexpensive, and yet strong post assembly/repair that allows replacement or repair of a post without the time-consuming and costly necessity of replacing in-ground or in-concrete mounts.

BRIEF SUMMARY OF THE INVENTION

A slide lock post assembly comprises sub-component assemblies, including: a post slide plate and a wedge plate (collectively, an anchor assembly) which fit within an anchor receiver. Additionally, a decorative shroud can be incorporated into the assembly as well. The assembly can be used in a variety of situations.

In a common scenario, a post will have settled or weakened or otherwise needs to be replaced with a longer/better post. In such an instance, the existing post is simply cut off near the ground/mount, leaving enough of the existing post (thereafter referred to as the base post) to securely affix thereto the slide lock post assembly. This is accomplished by attachment of the anchor receiver to the base post via a plurality of base attachment members. In an alternate embodiment, the anchor receiver is otherwise affixed to the base post without the need for any separate base attachment members (for example, in the case of a steel post, it can be welded). Strong, weather-resistant materials should be used to construct the assembly. Appropriate materials, include, but are not limited to steel alloys, galvanized steel plate, etc.

The base post can be an actual post or it can be any sufficiently sturdy base material including concrete, stone, wood, or other suitable items.

The post slide plate can be affixed to a repair post which is a new/replacement/longer/stronger post. This can be accomplished utilizing a plurality of slide attachment members. In an alternate embodiment, the post slide plate is welded or otherwise affixed to the repair post without the need for any separate slide attachment members.

The post slide plate can then be slid into an inner cavity within the anchor receiver. Because of the tight tolerances, a compression fit can be used to ensure that the post slide plate fits snuggly and firmly in place within the anchor receiver. The post slide plate has a top surface which can approximately match up with a bottom surface of the repair post. The post slide plate has side walls that flare gradually outwards so that a bottom surface of the post slide plate is larger in area than the top surface of the post slide plate, thereby ensuring that the post slide plate can not be pulled upwards and out of the inner cavity of the anchor receiver once it has been installed therein.

One or more of a plurality of security pins can be tightened against the post slide plate and anchor receiver such that the post slide plate is secured within the anchor receiver.

The wedge plate is also installed in the inner cavity within the anchor receiver. The wedge plate supports the weight of the repair post and attached post slide plate and transfers that weight to the anchor receiver and thence to the base post. In one embodiment, the wedge plate and post slide plate are separate components. In another embodiment, the wedge plate and post slide plate are integral.

If desired, a decorative shroud can be slid over the other parts of the slide lock post assembly to conceal said components and beautify the resulting post repair.

DETAILED DESCRIPTION

Figure 1:
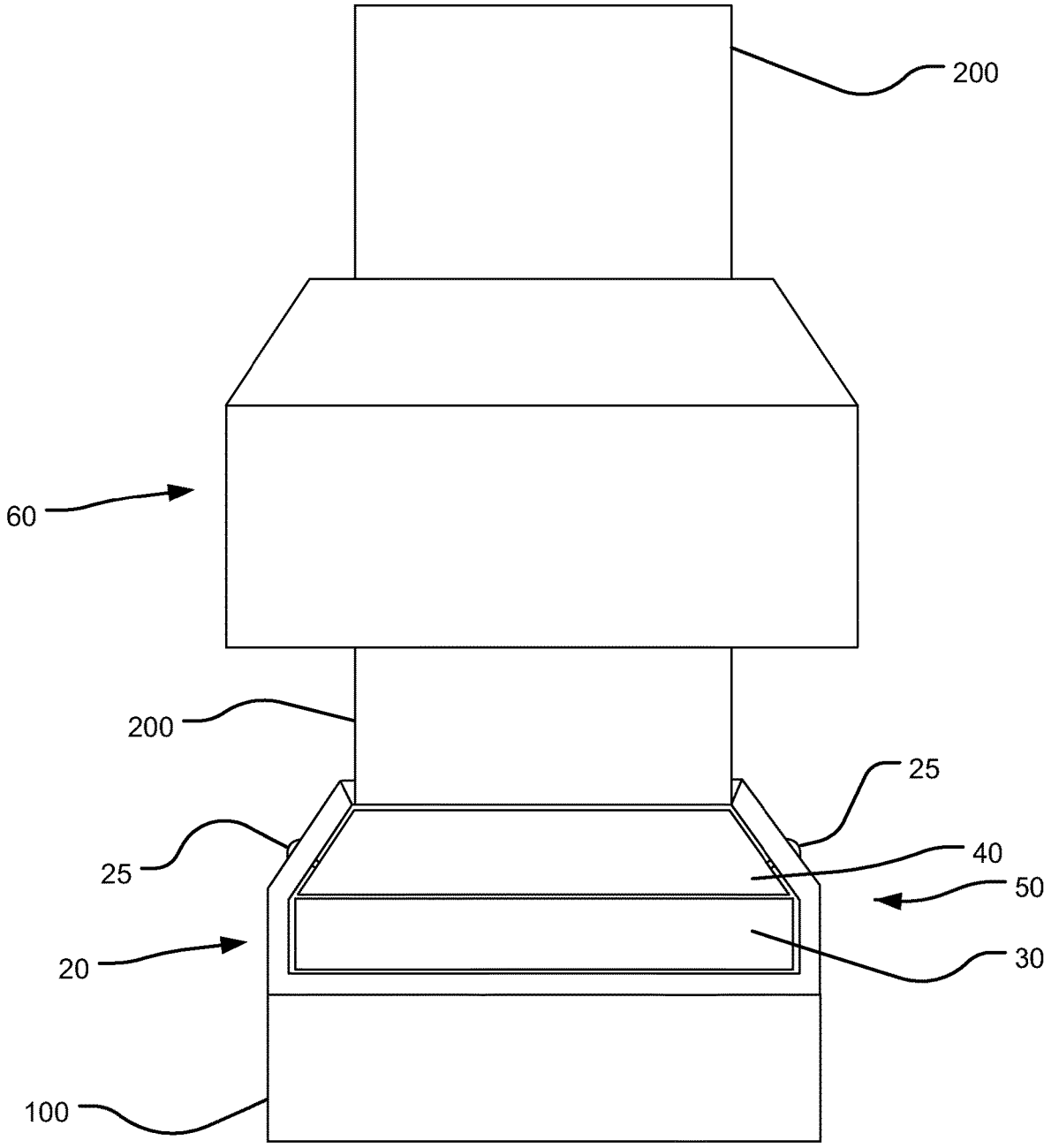
FIG. 1 illustrates a front elevation view of an exemplary embodiment of a slide lock post assembly.

In the following discussion, numerous specific details are set forth to provide a thorough understanding of the present disclosure. However, those skilled in the art will appreciate that embodiments may be practiced without such specific details. Furthermore, lists and/or examples are often provided and should be interpreted as exemplary only and in no way limiting embodiments to only those examples. Similarly, in this disclosure, language such as "could, should, may, might, must, have to, can, would, need to, is, is not", etc. and all such similar language shall be considered interchangeable whenever possible such that the scope of the invention is not unduly limited. For example, a comment such as: "item X is used" can be interpreted to read "item X can be used".

Exemplary embodiments are described below and in the accompanying Figures. The following detailed description provides a review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

Referring now to the drawings, FIG. 1 illustrates a front elevation view of an exemplary embodiment of a slide lock post assembly 10 comprising a number of sub-component assemblies, including: a post slide plate 40, a wedge plate 30, an anchor receiver 20, and a decorative shroud 60. The assembly 10 is installed on a base post 100 and functions to attach a repair post 200 securely to the base post 100. The base post 100 can be a wood post, a concrete post or pad, a stone foundation, or any other suitably strong and sturdy item to which a post can be mounted.

In one embodiment, a slide lock post assembly 10 is called for to repair a situation with a deck support post. In this scenario, a support post for a deck had been originally set in a permanent concrete foundation to ensure that the post did not move. However, the materials under the concrete were not properly compacted during installation and the entire concrete/post assembly consequently settled. This caused the deck to warp and began to compromise at least the aesthetics if not the structural integrity of the deck. In order to correct this problem, the prior art would likely require complete removal of the post's concrete foundation and installation of a new, longer post in the old hole—a time-consuming, expensive, and difficult job. Alternatively, the present invention can fix the problem with minimal cost and effort. Instead of requiring excavation and removal of the old post's concrete foundation and replacement with new concrete after installation of a new, longer post, the present invention allows for a user to simply cut off the old post (i.e., the base post 100) and attach a new post (i.e., the repair post 200) thereto via the slide lock post assembly. As such, the existing concrete foundation can be used without requiring the removal and re-pouring of concrete.

This is accomplished by first attaching the anchor receiver 20 securely to the base post 100 via a plurality of base attachment members. In an alternate embodiment, the anchor receiver 20 is welded or otherwise affixed to the base post 100 without the need for any separate base attachment members. In yet another embodiment, the base post 100 is concrete or whatever material formed the foundation of the prior post and the anchor receiver 20 is mounted directly thereto without using an intervening length of the old post material.

Next, the wedge plate 30 is installed in the anchor receiver 20. In one embodiment, the wedge plate 30 is basically a rectangular cuboid. The wedge plate 30 can be "hollow", having three side surfaces and a top surface, but no bottom surface, and with one open side. This configuration allows the open side of the wedge plate 30 to be slid into the anchor receiver 20 even if bolt heads or other obstructions are present within the anchor receiver's inner cavity 70 (see FIG. 2). In another embodiment, the wedge plate 30 is not hollow but is instead solid (except for a plurality of wedge attachment ports 31, 32, 33 and 34—not shown in FIG. 1, see FIG. 3—which allow access through the wedge plate to a plurality of base attachment members 26, 27, 28, and 29, see FIGS. 2 and 3). In one embodiment, bolt heads are countersunk so the wedge plate 30 can have a bottom surface. In another embodiment, grooves are cut into the bottom surface so that the wedge plate 30 can slide over bolt heads.

The post slide plate 40 is affixed to the bottom of the repair post 200. This can be accomplished utilizing a plurality of slide attachment members 46, 47, 48 and 49 (not shown in FIG. 1, see other FIGs.). In an alternate embodiment, the post slide plate 40 is welded or otherwise affixed to the repair post 200 without the need for any separate slide attachment members.

Once the post slide plate 40 is properly affixed to the repair post 200, the post slide plate 40 can be slid into the space immediately above the wedge plate 30 within the inner cavity 70 (see FIG. 2) of the anchor receiver 20. The combination of the post slide plate 40 and the wedge plate 30 is called the anchor assembly 50. Because of the tight tolerances, a compression fit can be used to ensure that the anchor assembly 50 fits snuggly and firmly in place within the anchor receiver 20. With the anchor assembly 50 filling the inner cavity 70 of the anchor receiver 20, the assembly 10 is inherently strong and stable.

The post slide plate 40 has a top surface which can approximately match up with a bottom surface of the repair post 200. The post slide plate 40 has side walls 45 (see FIG. 3) that flare outwards so that a bottom surface of the post slide plate 40 is larger in area than the top surface of the post slide plate 40, thereby ensuring that the post slide plate 40 can not be pulled upwards and out of the inner cavity 70 of the anchor receiver once it has been installed therein. Furthermore, the sloping side walls 45 mate up with the interior sloping walls of the inner cavity 70 of the anchor receiver, ensuring a snug fit and minimal play between the various components once installation is complete.

One or more of a plurality of security pins 25 can be tightened against the post slide plate 40 and anchor receiver 20 such that the post slide plate is secured within the anchor receiver.

If desired, a decorative shroud 60 can slide over the other parts of the slide lock post assembly 10 to conceal said components and beautify the resulting post repair. In the illustration of FIG. 1, an exemplary decorative shroud 60 is shown on the repair post, ready to be slid downwards to cover other portions of the slide lock post assembly 10.

Figure 2:
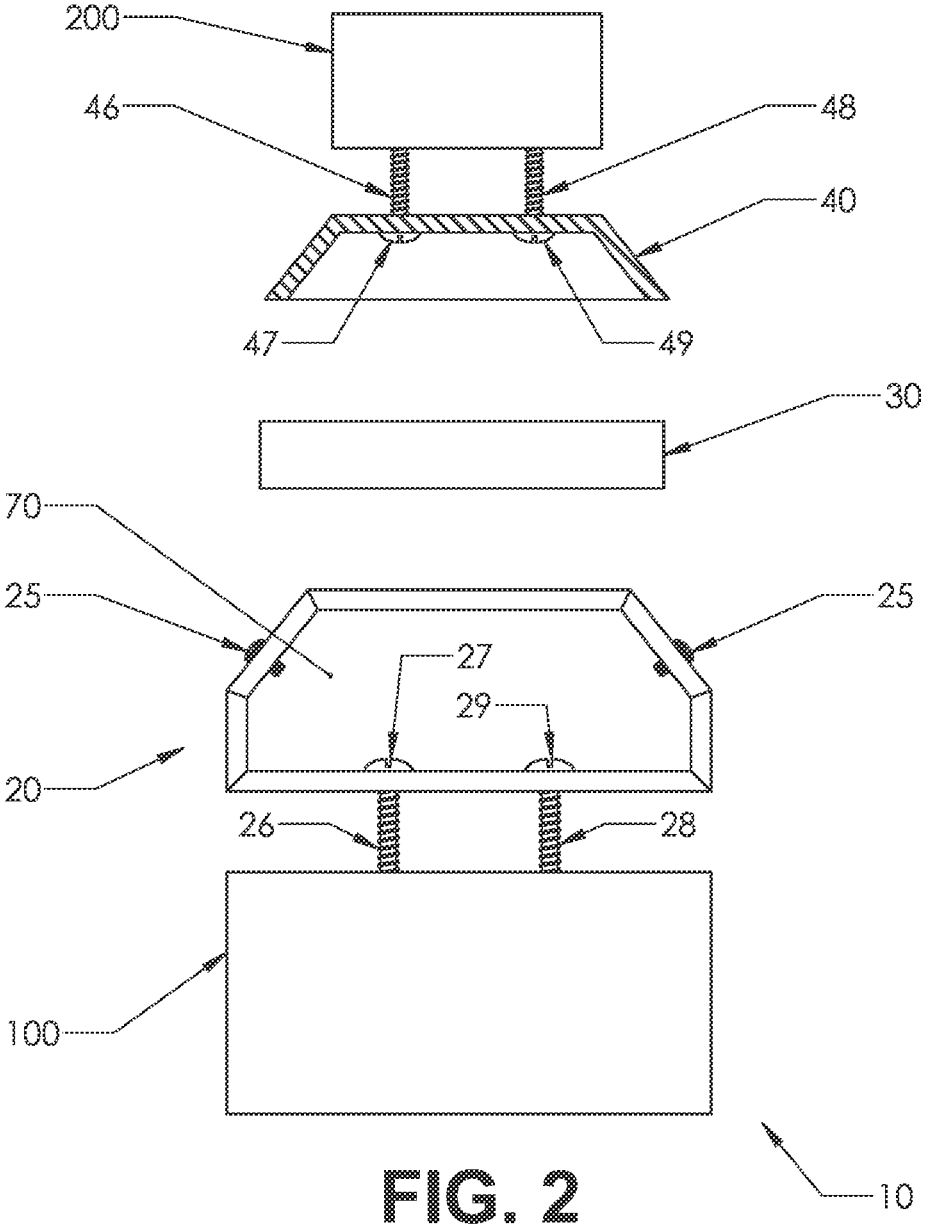
FIG. 2 illustrates a front elevation exploded view of an exemplary embodiment of a slide lock post assembly.

FIG. 2 illustrates a front elevation exploded view of an exemplary embodiment of a slide lock post assembly 10. A repair post 200 is shown at the top of the illustration connected to the post slide plate 40 by a plurality of slide attachment members 46, 47, 48 and 49 (only the front two slide attachment members 46 and 48 are visible in the embodiment illustrated in FIG. 2, the location of back members 47 and 49 can vary as can the number of such members). In the illustration in FIG. 2, the plurality of slide attachment members 46, 47, 48, and 49 appear to resemble lag bolts; however, in other embodiments, other types of attachment members can be utilized. Since the front side wall of the post slide plate 40 would block the view of the interior if it was shown, it has been cut away with the post slide plate 40 being shown in cross section in FIG. 2.

Below the post slide plate 40 is the wedge plate 30. Note how it is approximately the same width as the post slide plate 40 such that the two mate up when placed within the inner cavity of the anchor receiver 20. However, since FIG. 2 is an exploded view, the anchor receiver 20 is shown as having an empty inner cavity except for the heads of the plurality of base attachment members 26, 27, 28, and 29 and the ends of the plurality of security pins 25. The security pins 25 can selectively extend through the wall of the anchor receiver 20 and into the inner cavity so as to contact and lock in place the post slide plate 40 when the slide plate 40 is in position within the inner cavity of the anchor receiver 20. Note that only the front two of the plurality of base attachment members 26 and 28 are visible in FIG. 2, the positions of the back two members 27 and 29 can vary, as can the number of such members.

Figure 3:
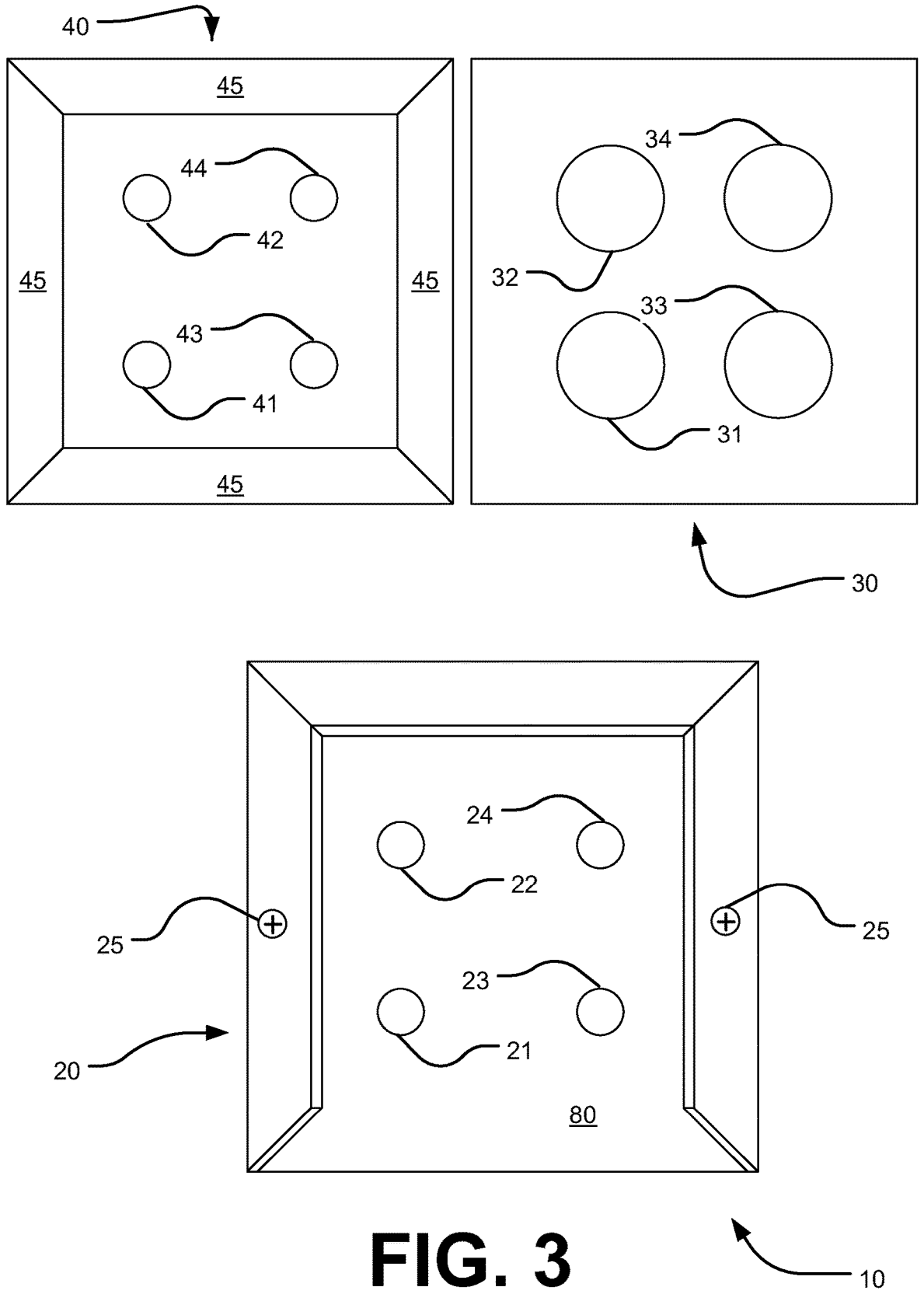
FIG. 3 illustrates a top plan view of an exemplary embodiment of a slide lock post assembly.

FIG. 3 illustrates a top plan view of an exemplary embodiment of a slide lock post assembly 10. Three components, the post slide plate 40, the wedge plate 30 and the anchor receiver 20 are illustrated. Note that the post slide plate 40 has a plurality of slide attachment ports 41, 42, 43, and 44. The slide attachment ports provide locations for a plurality of slide attachment members 46, 47, 48 and 49 (not shown in FIG. 3, see FIG. 2) to pass through the post slide plate 40 and into the repair post 200 to securely attach the post slide plate 40 to the repair post 200. In other embodiments more or fewer slide attachment ports and slide attachment members can be used. In fact, an embodiment is contemplated that utilizes zero ports and members and the slide plate 40 is instead attached to the repair post 200 utilizing other means (such as by welding, gluing, epoxying, etc.).

The anchor receiver 20 is illustrated in FIG. 3 with a plurality of base attachment ports 21, 22, 23, and 24. The base attachment ports provide locations for a plurality of base attachment members 26, 27, 28 and 29 (not shown in FIG. 3, see FIG. 2) to pass through the bottom plate 80 of the anchor receiver 20 and into the base post 100 to securely attach the anchor receiver 20 to the base post 100. In other embodiments more or fewer base attachment ports and base attachment members can be used. In fact, an embodiment is contemplated that utilizes zero ports and members and the anchor receiver 20 is instead attached to the base post 100 utilizing other means (such as by welding, gluing, epoxying, etc.).

The wedge plate 30 is illustrated in FIG. 3 with a plurality of wedge attachment ports 31, 32, 33, and 34. These ports provide access through the wedge plate 30 to the plurality of base attachment members 26, 27, 28 and 29 when the wedge plate 30 is in place within the cavity of the anchor receiver 20. In other embodiments, the number of wedge attachment ports can be zero, one, two, three, four, five, six or even more.

While particular embodiments have been described and disclosed in the present application, it is clear that any number of permutations, modifications, or embodiments may be made without departing from the spirit and the scope of this disclosure.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiment or form disclosed herein or to the particular fields of usage mentioned above. While specific embodiments and examples are described above for illustrative purposes, various equivalent modifications are possible within the scope of the disclosure, as those skilled in the relevant art will recognize. Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, as well as those listed above, are incorporated herein by reference in their entirety. Aspects of embodiments can be modified, if necessary, to employ the systems, functions, and concepts of the various references to provide yet further embodiments.

In light of the above "Detailed Description," the inventor may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed by the inventor. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventor contemplates the various aspects in any number of claim forms. Accordingly, the inventor reserves the right to add additional claims after filing the application to pursue such additional claim forms for other aspects.

The above specification, examples and data provide a description of the structure and use of exemplary implementations of the described systems, articles of manufacture and methods. It is important to note that many implementations can be made without departing from the spirit and scope of the invention.

What is claimed is:

1. A slide lock post assembly, comprising:

a post slide plate having a top surface and a bottom surface;

the top surface is separated from the bottom surface by a plurality of sloping side walls;

a top surface area is less than a bottom surface area;

an anchor receiver having an inner cavity;

the inner cavity having interior sloping walls;

the post slide plate engageable within the inner cavity of the anchor receiver with the plurality of sloping side walls abutting the interior sloping walls;

a wedge plate fitting within the inner cavity of the anchor receiver below the post slide plate;

the anchor receiver is removably attachable to a base post; and the post slide plate top surface is removably attachable to a repair post.

2. The slide lock post assembly of claim 1, further comprising a decorative shroud that slides over the anchor receiver and hides the anchor receiver from view.

3. The slide lock post assembly of claim 1, further comprising:

a plurality of base attachment members removably attaching the anchor receiver to the base post;

each of the plurality of base attachment members passing through one of a plurality of base attachment ports in a bottom plate of the anchor receiver.

4. The slide lock post assembly of claim 2, further comprising:

a plurality of base attachment members removably attaching the anchor receiver to the base post;

each of the plurality of base attachment members passing through one of a plurality of base attachment ports in a bottom plate of the anchor receiver.

5. The slide lock post assembly of claim 1, further comprising:

a plurality of slide attachment members removably attaching the post slide plate to the repair post;

each of the plurality of slide attachment members passing through one of a plurality of slide attachment ports in the post slide plate.

6. The slide lock post assembly of claim 2, further comprising:

a plurality of slide attachment members removably attaching the post slide plate to the repair post;

each of the plurality of slide attachment members passing through one of a plurality of slide attachment ports in the post slide plate.

7. The slide lock post assembly of claim 3, further comprising:

a plurality of slide attachment members removably attaching the post slide plate to the repair post;

each of the plurality of slide attachment members passing through one of a plurality of slide attachment ports in the post slide plate.

8. The slide lock post assembly of claim 4, further comprising:

a plurality of slide attachment members removably attaching the post slide plate to the repair post;

each of the plurality of slide attachment members passing through one of a plurality of slide attachment ports in the post slide plate.

9. The slide lock post assembly of claim 3, further comprising:

a plurality of wedge attachment ports in the wedge plate;

each of the wedge attachment ports providing a user access to one of the plurality of base attachment members when the wedge plate is in place within the inner cavity of the anchor receiver.

10. The slide lock post assembly of claim 4, further comprising:

a plurality of wedge attachment ports in the wedge plate;

each of the wedge attachment ports providing a user access to one of the plurality of base attachment members when the wedge plate is in place within the inner cavity of the anchor receiver.

11. The slide lock post assembly of claim 7, further comprising:

a plurality of wedge attachment ports in the wedge plate;

each of the wedge attachment ports providing a user access to one of the plurality of base attachment members when the wedge plate is in place within the inner cavity of the anchor receiver.

12. The slide lock post assembly of claim 8, further comprising:

a plurality of wedge attachment ports in the wedge plate;

each of the wedge attachment ports providing a user access to one of the plurality of base attachment members when the wedge plate is in place within the inner cavity of the anchor receiver.

13. The slide lock post assembly of claim 1, further comprising:

a plurality of security pins securing the post slide plate within the inner cavity of the anchor receiver.

14. The slide lock post assembly of claim 2, further comprising:

a plurality of security pins securing the post slide plate within the inner cavity of the anchor receiver.

15. The slide lock post assembly of claim 4, further comprising:

a plurality of security pins securing the post slide plate within the inner cavity of the anchor receiver.

16. The slide lock post assembly of claim 6, further comprising:

a plurality of security pins securing the post slide plate within the inner cavity of the anchor receiver.

17. The slide lock post assembly of claim 8, further comprising:

a plurality of security pins securing the post slide plate within the inner cavity of the anchor receiver.

18. The slide lock post assembly of claim 9, further comprising:

a plurality of security pins securing the post slide plate within the inner cavity of the anchor receiver.

19. The slide lock post assembly of claim 10, further comprising:

a plurality of security pins securing the post slide plate within the inner cavity of the anchor receiver.

20. The slide lock post assembly of claim 12, further comprising:

a plurality of security pins securing the post slide plate within the inner cavity of the anchor receiver.

* * * * *